US007797899B2

(12) United States Patent
Linn et al.

(10) Patent No.: US 7,797,899 B2
(45) Date of Patent: Sep. 21, 2010

(54) TEMPORARY FLOOR JOINT FILLER

(75) Inventors: Carl Jeffery Linn, Gretna, NE (US); Leszek Krochmal, Orebro (SE)

(73) Assignee: Nox-Crete Products Group, Omaha, NE (US)

( * ) Notice: Subject to any disclaimer, the term of this patent is extended or adjusted under 35 U.S.C. 154(b) by 0 days.

(21) Appl. No.: 12/217,460

(22) Filed: Jul. 3, 2008

(65) Prior Publication Data

US 2009/0145070 A1 Jun. 11, 2009

Related U.S. Application Data

(60) Provisional application No. 61/005,710, filed on Dec. 7, 2007.

(51) Int. Cl.
*E04C 3/00* (2006.01)
*E04D 1/36* (2006.01)

(52) U.S. Cl. ..... 52/465; 52/742.1; 52/273; 52/459; 52/461; 52/463; 52/464

(58) Field of Classification Search ..... 52/465, 52/742.1, 273, 459, 461, 463, 464; 404/67–69
See application file for complete search history.

(56) References Cited

U.S. PATENT DOCUMENTS 3,308,726 A * 3/1967 Dreher ..... 404/67
3,320,706 A * 5/1967 Elliott et al. ..... 52/393
3,411,260 A * 11/1968 Dill ..... 52/396.03
3,469,510 A * 9/1969 Worson ..... 404/69
3,575,094 A * 4/1971 Hewitt et al. ..... 404/65
3,871,787 A * 3/1975 Stegmeier ..... 404/48
3,896,597 A * 7/1975 Deason ..... 52/396.02
4,129,967 A * 12/1978 Barlow ..... 52/15
4,461,131 A * 7/1984 Pressell ..... 52/395
4,841,704 A * 6/1989 Jarrell ..... 52/396.02
5,375,386 A * 12/1994 Goad ..... 52/396.03
6,550,202 B2 * 4/2003 Sandoz et al. ..... 52/352
6,550,205 B2 * 4/2003 Neuhofer, Jr. ..... 52/464
6,588,165 B1 * 7/2003 Wright ..... 52/506.05
6,948,716 B2 * 9/2005 Drouin ..... 277/606
2002/0000072 A1 * 1/2002 McGrath et al. ..... 52/466

* cited by examiner

*Primary Examiner*—Richard E Chilcot, Jr.
*Assistant Examiner*—Mark R Wendell
(74) *Attorney, Agent, or Firm*—Suiter Swantz pc llo

(57) ABSTRACT

A temporary floor joint filler may include a base member having a cross-sectional profile including a first set of opposing sides and a second set of opposing sides, a cap coupled to the base member, a first fin coupled with a first side of the second set of opposing sides of the base member, and/or a second fin coupled with a second side of the second set of opposing sides of the base member. The base member may be configured for insertion into a floor joint, the first fin and the second fin may be configured for retaining the base member in the floor joint, and the cap may be configured for covering the floor joint.

15 Claims, 6 Drawing Sheets

TEMPORARY FLOOR JOINT FILLER

CROSS-REFERENCE TO RELATED APPLICATIONS

The present application claims the benefit under 35 U.S.C. §119(e) of U.S. Provisional Application Ser. No. 61/005,710, filed Dec. 7, 2007. Said U.S. Provisional Application Ser. No. 61/005,710 is herein incorporated by reference in its entirety.

TECHNICAL FIELD

The disclosure generally relates to the field of tilt-up concrete construction, and more particularly to temporary floor joint filler.

BACKGROUND

A smooth surface is the primary objective when producing concrete wall panels. To make concrete wall panels, construction workers use a method commonly referred to as "tilt-up" construction. When using this method, the concrete used to make the wall panel is placed over an already cured concrete floor slab. Oftentimes, this floor slab has joints which have been cut into the slab, creating deep cuts in the otherwise smooth and clean surface. A liquid applied bond breaker is usually placed atop the cured concrete to prevent the two pieces from sticking together. After the concrete has developed sufficient strength, the wall panel may be tilted vertically into the appropriate place, creating a wall. Because the wall panel was cast over the concrete floor slab, the wall panel may include large ridges running across the wall panel corresponding to where the wall panel concrete seeped into the pre-cut floor joints. Workers are then required to spend a substantial amount of time fixing the wall panel's imperfections created by pre-cut floor joints by grinding the ridges down until the wall panel is smooth.

Consequently, it is desirable to provide a filler which would be capable of covering pre-cut floor joints in concrete floor slabs.

SUMMARY OF THE INVENTION

Accordingly, the present invention is directed to a method and apparatus for covering and sealing pre-cut joints in concrete floor slabs. A temporary floor joint filler may be comprised of a flexible, reusable material, creating a support member for longitudinally inserting into pre-cut floor joints. The support member may include a plurality of longitudinally oriented fins for securing the support member within the floor joint. The support member may further include a cap for preventing wall panel concrete from seeping into the pre-cut joint, such as when the concrete shrinks during curing, increasing the size of the pre-cut floor joint.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Figure 1:
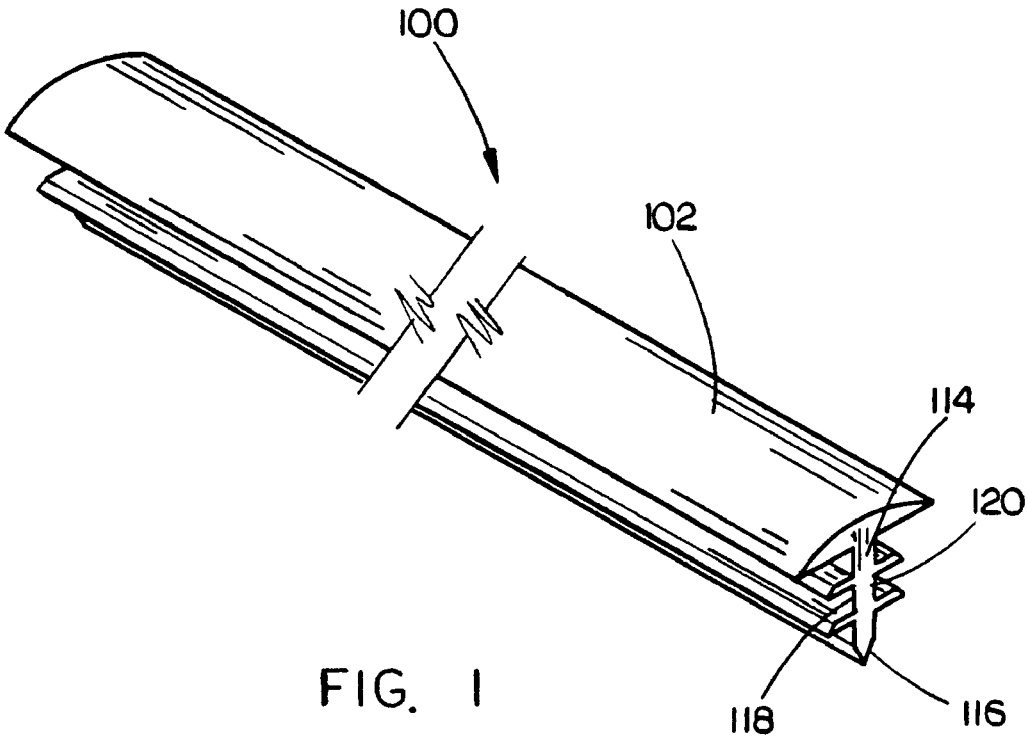
FIG. 1 is a partial isometric view illustrating temporary floor joint filler.
Figure 2:
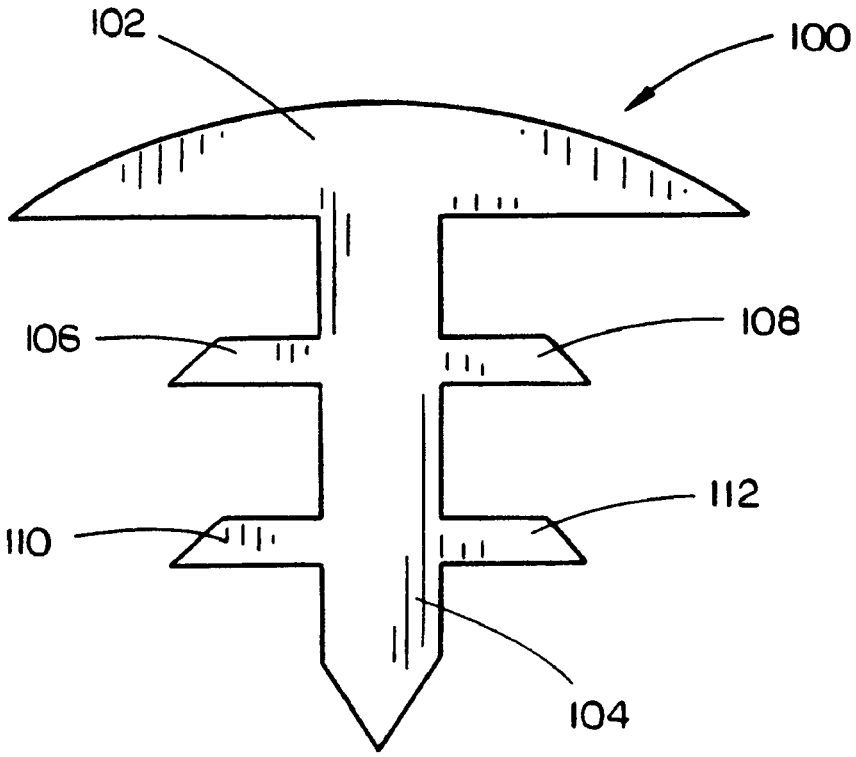
FIG. 2 is an end view illustrating temporary floor joint filler, wherein the temporary floor joint filler comprises a cap and four fins oriented substantially perpendicular to the base member.

Referring generally to FIGS. 1 and 2, a temporary, reusable floor joint filler 100 is described in accordance with an exemplary embodiment of the present invention. The temporary floor joint filler 100 may include a cap 102, a base member 104, one or more fins 106, 108, 110 and 112, a first set of opposing sides 114 and 116, and a second set of opposing sides 118 and 120. The cap 102 may be coupled to the first side 114 of the first set of opposing sides 114 and 116. The first fin 106 may be coupled to the first side 118 of the second set of opposing sides 118 and 120. The second fin 108 may be coupled to the second side of the second set of opposing sides 118 and 120. In this embodiment, the cap 102 and one or more fins 106, 108, 110 and 112 are included for securing temporary floor joint filler 100 into a joint 122 (as illustrated in FIGS. 1 through 2 and 6 through 8). In another embodiment, a cap 102 and one or more fins 106, 108, 110 and 112 are included for sealing the joint 122 (as illustrated in FIGS. 1 through 2 and 6 through 8).

In some embodiments, the temporary floor joint filler 100 may be constructed from a flexible (and possibly reusable) material, such as rubber. It is contemplated that any type of rubber may be employed for temporary floor joint filler 100. In one specific embodiment, an American Society for Testing and Materials (ASTM) rubber with a Shore A hardness of a range 20-100 may be utilized. For example, the temporary floor joint filler 100 may be constructed from a material selected to provide flexibility for inserting the temporary floor joint filler 100 into a pre-cut concrete joint 122, while still providing adequate strength for supporting concrete. Further, it will be appreciated that certain materials may be selected according to other design considerations, including reusability and/or disposability. For instance, in one embodiment, silicon and/or another non-stick material may be selected for reusability; while in another embodiment, a biodegradable material may be selected for disposability.

Figure 3:
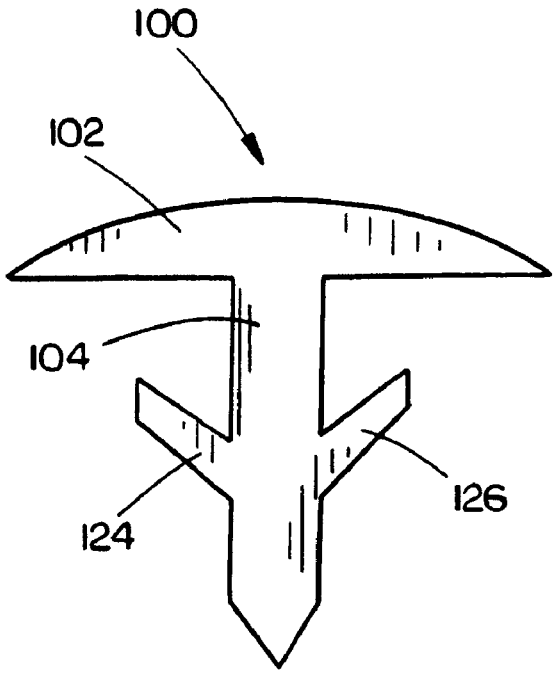
FIG. 3 is an end view illustrating temporary floor joint filler, wherein the temporary floor joint filler comprises a cap and two fins oriented at an angle from the base member.
Figure 4:
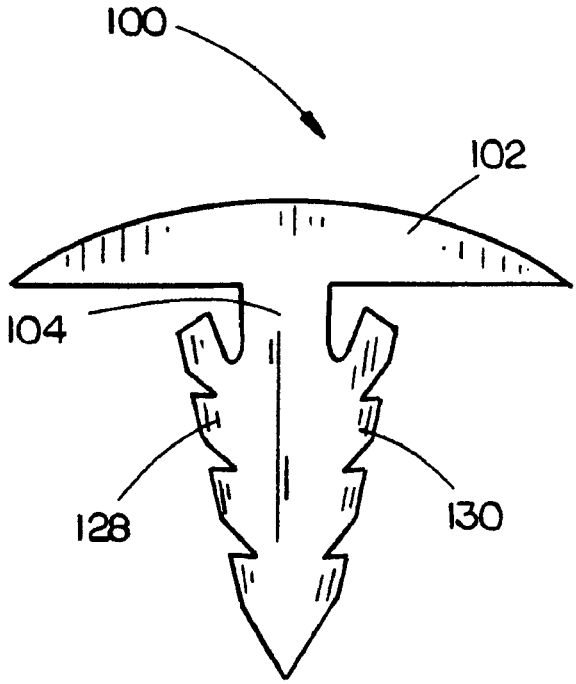
FIG. 4 is an end view illustrating temporary floor joint filler, wherein the temporary floor joint filler comprises a cap and six ridged fins coupled to the base member.
Figure 5:
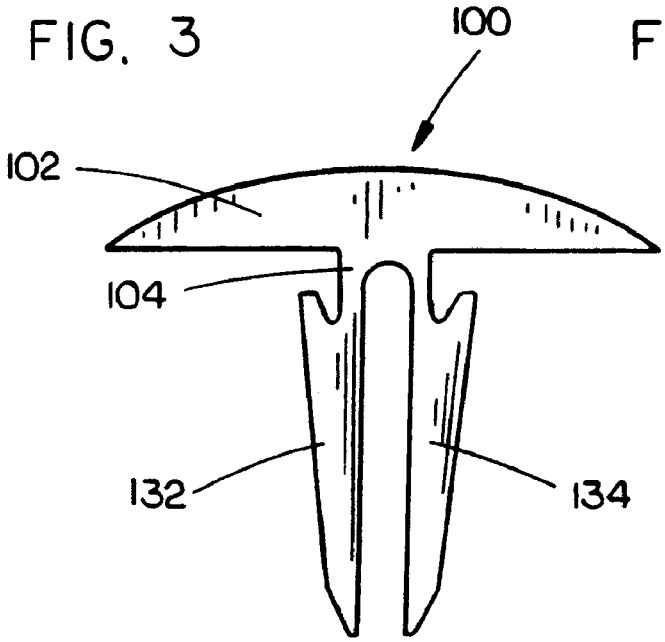
FIG. 5 is an end view illustrating temporary floor joint filler, wherein the temporary floor joint filler comprises a cap and two elongated fins coupled to the base member.

Referring now to FIGS. 3 through 5, a temporary floor joint filler 100 is described in accordance with the present invention. For example, in one embodiment a temporary floor joint filler 100 may include a cap 102 and one or more fins 124 and 126 oriented at an angle from a base member 104 for securing temporary floor joint filler 100 into a joint 122 (as illustrated in FIGS. 3 and 6 through 8). In another embodiment, a temporary floor joint filler 100 may include a cap 102 and one or more ridged fins 128 and 130 coupled to the base member 104 for securing temporary floor joint filler 100 into a joint 122 (as illustrated in FIGS. 4 and 6 through 8). In still a further embodiment, a temporary floor joint filler 100 may include a cap 102 and one or more elongated fins 132 and 134 coupled to the base member 104 for securing temporary floor joint filler 100 into a joint 122 (as illustrated in FIGS. 5 and 6 through 8). It will be appreciated that the orientation and design of the fins may be varied according to other design considerations, including flexibility and/or retention within a joint 122.

In some embodiments, a temporary floor joint filler 100 may include a base member 104 coupled to the center of the cap 102 for securing temporary floor joint filler 100 into a joint 122. In other embodiments, a temporary floor joint filler 100 may include a base member 104 coupled to the side of the cap 102 for securing temporary floor joint filler 100 into a joint 122. It will be appreciated that the orientation and design of the cap and/or the base member may be varied according to other design considerations, including flexibility and/or retention within a joint 122.

Figure 6:
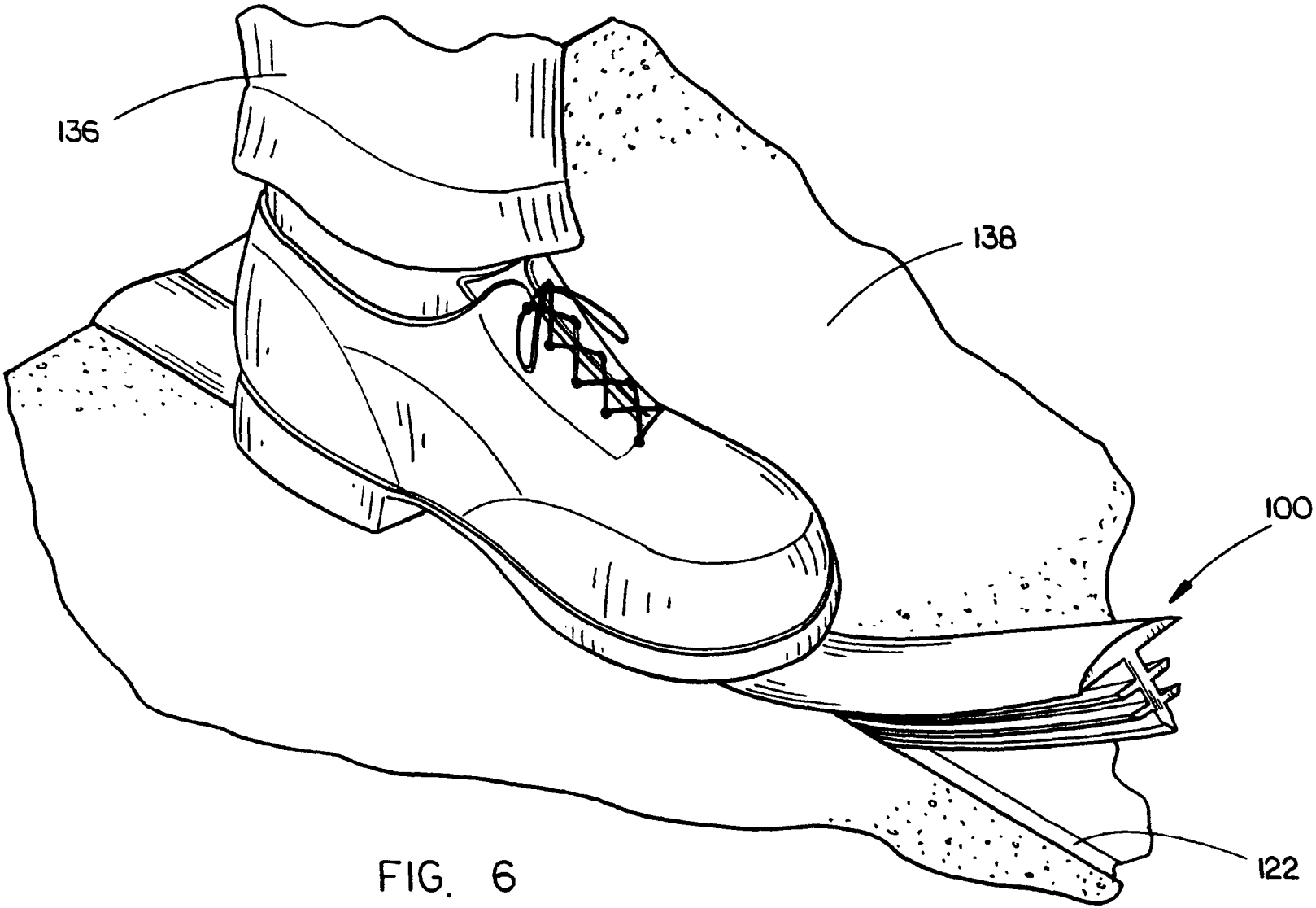
FIG. 6 is an isometric view illustrating insertion of a temporary floor joint filler into a sawcut joint.

Referring now to FIG. 6, a technique for inserting temporary floor joint filler 100 into a joint 122 is shown. The temporary floor joint filler 100 may be pressed into a joint 122 using an individual's foot 136. Installing the temporary floor joint filler 100 in this fashion may allow for simple and efficient preparation of a concrete slab 138 for subsequent construction activities.

In some embodiments, a tool may be used for inserting temporary floor joint filler 100 into a joint 122. For example, in one embodiment, temporary floor joint filler 100 may be pressed into joint 122 using a hand-held roller. In another embodiment, temporary floor joint filler 100 may be extruded into joint 122 using an extruding device. In still a further embodiment, temporary floor joint filler 100 may be threaded through joint 122. It is understood that a number of methods may be employed for inserting temporary floor joint filler 100 into joint 122 without departing from the scope and intent of the disclosure.

In some embodiments, various techniques may be employed to ensure temporary floor joint filler 100 is secured in joint 122. For example, in one embodiment, temporary floor joint filler 100 may be affixed into joint 122 with a temporary adhesive. In another embodiment, joint filler 100 may be anchored to at least one end of the concrete slab 138. These examples are meant to illustrate specific embodiments of the present invention and are not meant to be restrictive of the invention. Thus, it is understood that a number of methods may be employed for securing temporary floor joint filler 100 into joint 122 without departing from the scope and intent of the disclosure.

Figure 7:
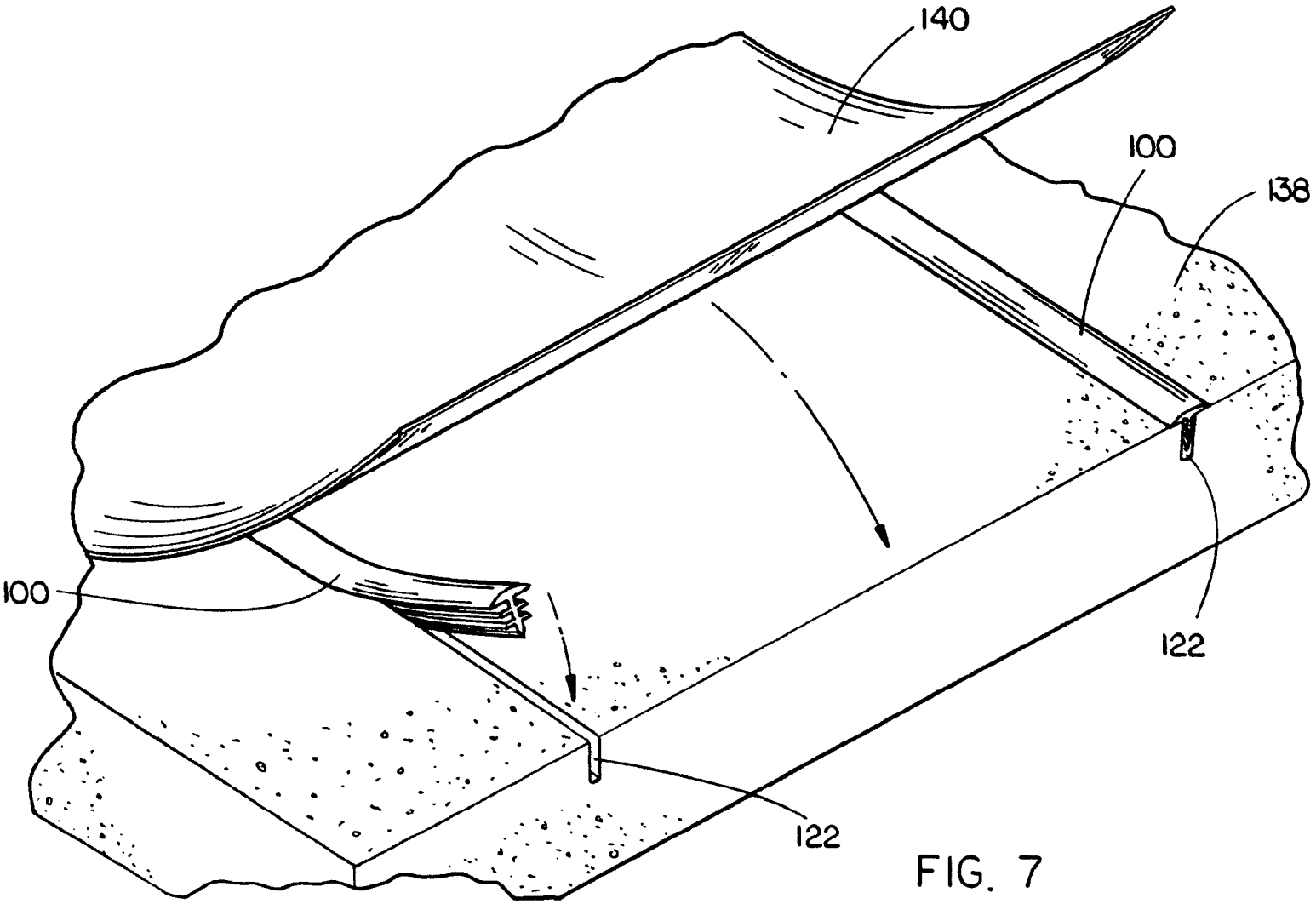
FIG. 7 is an exploded view illustrating placement of liquid applied bond breaker over a concrete floor slab and temporary floor joint fillers.
Figure 8:
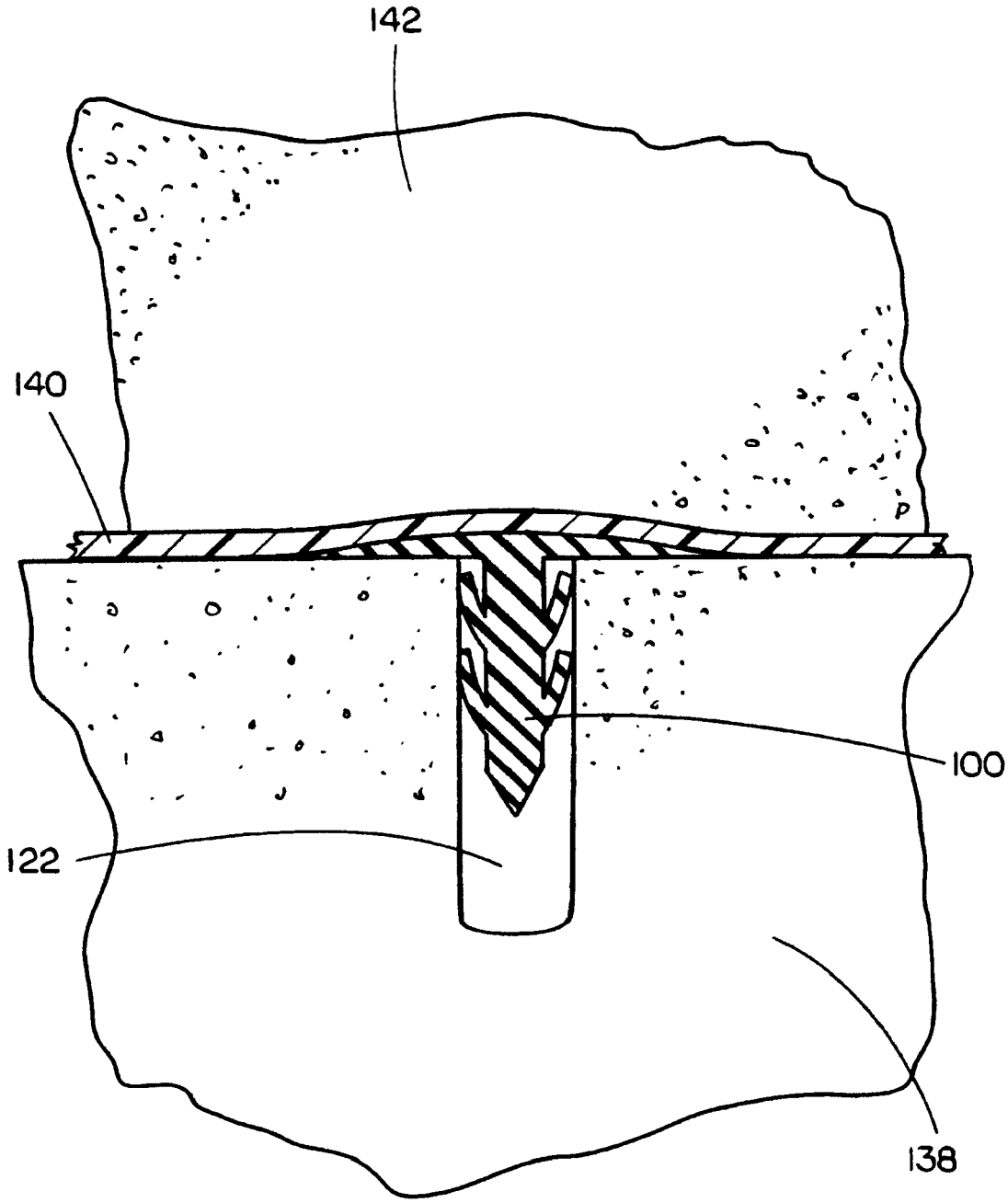
FIG. 8 is a partial cross-sectional end elevation view illustrating a concrete floor slab, a sawcut floor joint and a temporary floor joint filler covered with bond breaker, and a wall panel.
Figure 9:
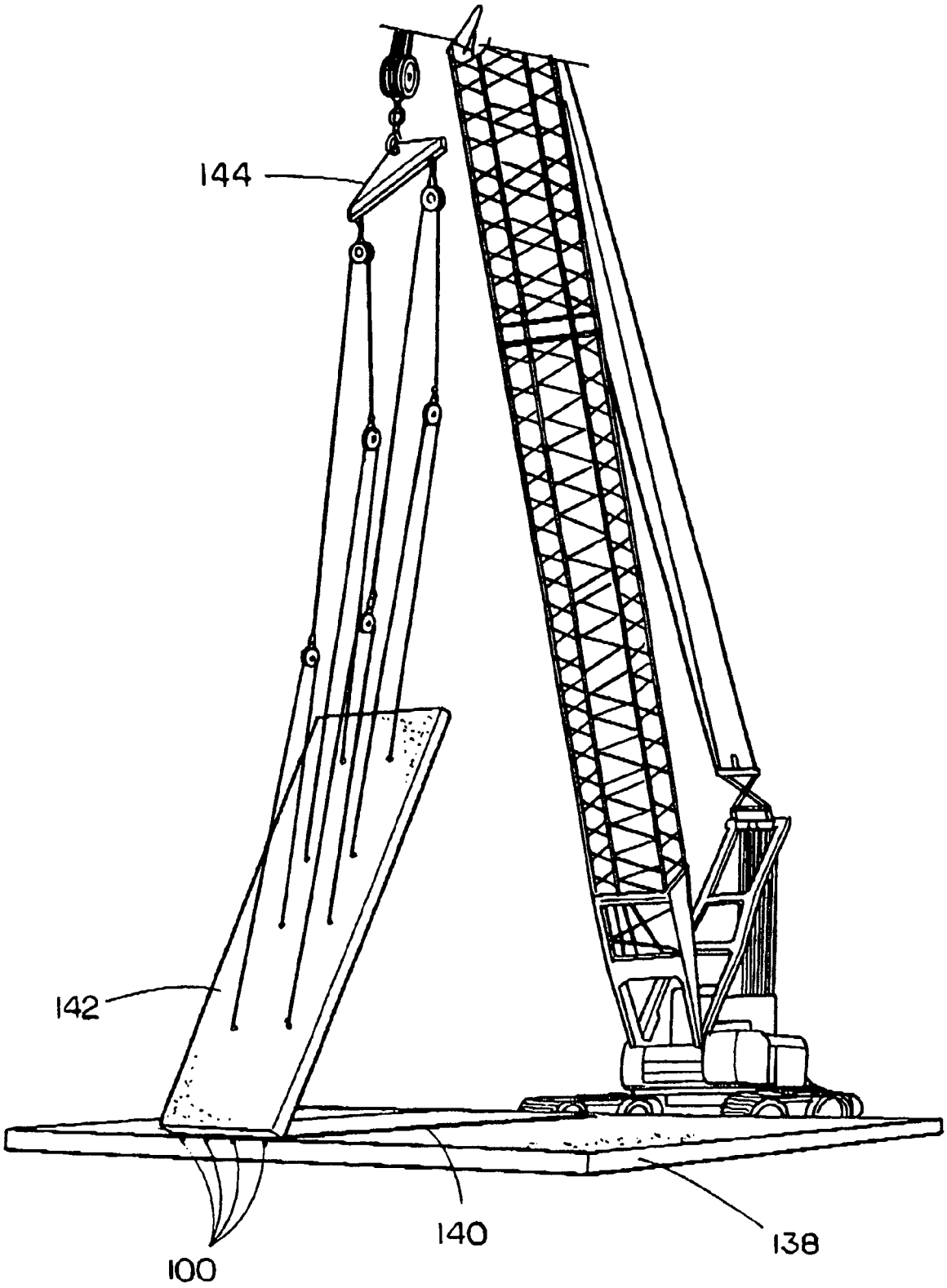
FIG. 9 is an isometric view illustrating a wall panel being moved to a vertical orientation from a concrete floor slab.

Referring now to FIGS. 7 through 9, a method for creating a wall panel 142 is shown. For example, the temporary floor joint filler 100 may be installed into a joint 122, bond breaker 140 may be applied over the temporary floor joint filler 100 and the concrete slab 138. A wall panel 142 may be fashioned by pouring concrete over the concrete slab 138. Once the wall panel 142 has developed sufficient strength, a crane 144 may be used to move the wall panel 142 into a vertical orientation from the concrete slab 138.

In some embodiments, multiple wall panels 142 may be fashioned by placing concrete over the concrete floor slab 138. For example, the temporary floor joint filler 100 may be installed into a sawcut joint 122, bond breaker 140 may be applied over the temporary floor joint filler 100 and the concrete floor slab 138. A wall panel 142 may be fashioned by placing concrete over the concrete floor slab 138. Once the wall panel 142 has developed sufficient strength, a crane 144 may be used to move the wall panel 142 into a vertical orientation from the concrete floor slab 138. The process may then repeat in order to produce the number of wall panels 142 desired.

It is believed that the temporary floor joint filler of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. An apparatus, comprising:

a base member;

a cap, said cap coupled to the base member;

a first fin, said first fin coupled with a first side of the second set of the base member;

a second fin, said second fin coupled with a second side of the base member, the first fin being oriented in an opposing direction to said second fin, wherein the base member is configured for insertion into a pre-cut concrete floor joint, the first fin and the second fin are configured for retaining the base member in the pre-cut concrete floor joint, the first fin is configured for flexibly conforming and contacting a first side of the pre-cut concrete floor joint, the second fin being configured for flexibly conforming and contacting a second side of the pre-cut concrete floor joint, the cap is configured for covering the pre-cut concrete floor joint, the cap is configured for sealing the joint to prevent wall panel concrete from entering the pre-cut concrete floor joint, the base member, the cap, the first fin, and the second fin are constructed from a flexible material and are configured for removal from the pre-cut concrete floor joint.

2. The apparatus of claim 1, wherein the base member, the cap, the first fin and the second fin are formed by unitary construction.

3. The apparatus of claim 1, wherein the first fin and the second fin have a beveled edge.

4. The apparatus of claim 1, wherein the first fin and the second fin have ridges.

5. The apparatus of claim 1, wherein the first fin and the second fin are elongated.

6. The apparatus of claim 1, further comprising a third fin, wherein the third fin is coupled to the first side of the base member.

7. The apparatus of claim 1, wherein the base member, the cap, the first fin, and the second fin are constructed from a non-stick material.

8. The apparatus of claim 6, further comprising a fourth fin, wherein the fourth fin is coupled to the second side of the base member.

9. The apparatus of claim 8, wherein the third fin is configured for flexibly conforming and contacting the first side of the pre-cut concrete floor joint.

10. The apparatus of claim 9, wherein the fourth fin is configured for flexibly conforming and contacting the second side of the pre-cut concrete floor joint.

11. An apparatus, comprising:

a base member;

a cap, said cap coupled to the base member;

a first fin, said first fin coupled with a first side of the base member;

a second fin, said second fin coupled with a second side of the base member, the first fin being oriented in an opposing direction to said second fin, wherein the base member is inserted into a pre-cut concrete floor joint, the first fin flexibly conforms and contacts a first side of the pre-cut concrete floor joint, the second fin flexibly conforms and contacts a second side of the pre-cut concrete floor joint, the cap covers the pre-cut concrete floor joint and seals the pre-cut concrete floor joint to prevent wall panel concrete from entering the pre-cut concrete floor joint, the base member, the cap, the first fin, and the second fin are constructed from a flexible material and are configured for removal from the pre-cut concrete floor joint.

12. The apparatus of claim 11, further comprising a third fin, the third fin is coupled to the first side of the base member.

13. The apparatus of claim 12, wherein the third fin flexibly conforms and contacts the first side of the pre-cut concrete floor joint.

14. The apparatus of claim 13, further comprising a fourth fin, the fourth fin is coupled to the second side of the base member.

15. The apparatus of claim 14, wherein the fourth fin flexibly conforms and contacts the second side of the pre-cut concrete floor joint.

* * * * *

UNITED STATES PATENT AND TRADEMARK OFFICE

CERTIFICATE OF CORRECTION

PATENT NO. : 7,797,899 B2
APPLICATION NO. : 12/217460
DATED : September 21, 2010
INVENTOR(S) : Carl Jeffery Linn and Leszek Krochmal It is certified that error appears in the above-identified patent and that said Letters Patent is hereby corrected as shown below:

In the Claims

Claim 1, Column 4, Line 30 - 31 should read –a first fin, said first fin coupled with a first side ~~of the second set~~ of the base member;

Signed and Sealed this
Twenty-second Day of July, 2014

Michelle K. Lee

Michelle K. Lee
*Deputy Director of the United States Patent and Trademark Office*